US009277330B2

(12) United States Patent
Aharoni et al.

(10) Patent No.: US 9,277,330 B2
(45) Date of Patent: Mar. 1, 2016

(54) OPTICAL PIN-POINT MICROPHONE

(75) Inventors: Abraham Aharoni, Rehovot (IL); Mordechai Segev, Haifa (IL); Zvi Katz, Maskeret Batya (IL)

(73) Assignee: TECHNION RESEARCH AND DEVELOPMENT FOUNDATION LTD., Haifa (IL)

( * ) Notice: Subject to any disclaimer, the term of this patent is extended or adjusted under 35 U.S.C. 154(b) by 949 days.

(21) Appl. No.: 12/567,325

(22) Filed: Sep. 25, 2009

(65) Prior Publication Data

US 2010/0189291 A1 Jul. 29, 2010

Related U.S. Application Data

(60) Provisional application No. 61/100,785, filed on Sep. 29, 2008.

(51) Int. Cl.
*H04R 23/00* (2006.01)
*H04R 25/00* (2006.01)

(52) U.S. Cl.
CPC ..... *H04R 23/008* (2013.01); *H04R 25/405* (2013.01)

(58) Field of Classification Search
CPC .... H04R 23/008; H04R 25/405; H04R 25/40; H04R 25/407
USPC ..... 381/172, 313, 318
See application file for complete search history.

(56) References Cited

U.S. PATENT DOCUMENTS 4,422,182 A * 12/1983 Kenjyo ..... 398/132
5,566,135 A * 10/1996 MacLeod ..... 367/149
6,590,661 B1 * 7/2003 Shnier ..... 356/432
8,023,669 B2 * 9/2011 Segev et al. ..... 381/172
2007/0215798 A1 * 9/2007 Kauppinen ..... H04R 23/008 250/231.1
2009/0097681 A1 * 4/2009 Puria ..... H04R 25/405 381/318
2009/0290739 A1 * 11/2009 Edwards et al. ..... 381/328
2010/0034409 A1 * 2/2010 Fay ..... H04R 25/554 381/326
2010/0048982 A1 * 2/2010 Puria ..... H04R 23/008 600/25
2010/0061562 A1 * 3/2010 Segev et al. ..... 381/71.4
2010/0321698 A1 * 12/2010 Santhanakrishnan et al. ..... 356/446

OTHER PUBLICATIONS

Scruby & Drain, Laser Ultrasonics Techniques and Applications, 1990, pp. 89-90, 95-96 and cover pages—6

* cited by examiner

*Primary Examiner* — Davetta W Goins
*Assistant Examiner* — Jasmine Pritchard
(74) *Attorney, Agent, or Firm* — Roach Brown McCarthy & Gruber, P.C.; Kevin D. McCarthy

(57) ABSTRACT

A system and method for directional sound sensing directs an optical sensing beam to an object of interest having a rough surface that vibrates acoustically. The light is reflected thereby and scattered as a speckle pattern that includes multiple speckles having a random distribution of phase offsets. A detector array having multiple detector elements receives and detects the speckle pattern and produces signals that are linearly proportional to phase modulation of the speckles. A summer receives signals from at least two of the detector elements that are offset at different phases and sums the received signals to generate a non-vanishing signal representative of an acoustic signal.

17 Claims, 11 Drawing Sheets

OPTICAL PIN-POINT MICROPHONE

CROSS-REFERENCE TO RELATED APPLICATION

This application is based upon and claims priority of commonly assigned U.S. Provisional Patent Application No. 61/100,785, filed Sep. 29, 2008, which is incorporated herein by reference in its entirety.

FIELD OF THE INVENTION

The present invention relates to a system and a method for directional sound sensing, and in particular, to directional microphones.

BACKGROUND OF THE INVENTION

The invention can be implemented to advantage in a variety of sound pick up applications requiring sensing of a specific source within a background of other sound sources. The invention makes use of a directional optical beam to illuminate the acoustic source of interest and pick up its sound-related vibrations, thereby identifying the source of interest. As the acoustic impedance of essentially all sources of interest, ranging from the human body, through musical instruments to artificial sound generators, is several order of magnitude larger than that of air, airborne sound from other sources is almost entirely reflected by the surfaces of the source of interest so that the optical beam picks up only the sound generated by the source of interest. To overcome instances where the optical detection of the surface vibrations of the sound source generate a different acoustic signature from that normally generated into air, an ordinary microphone is added. By fusing the signals from the optical pick-up and the airborne detection with the microphone, the normal airborne sound quality is accomplished, but background sound is significantly suppressed.

The ability to pick up voice signals from a distant person is of special interest here. In this case the optical sensor must pick up the minute vibrations generated in the speaker's body during speech. The optical detection of such vibrations, with typically sub-nanometer amplitudes, on a human skin with multi-micrometer roughness is a challenge addressed in this invention. The challenge is further exacerbated by the necessity to track and alleviate the effects of the relative motion of the target. Even a person at rest is expected to move randomly on a millimeter scale. In other words the optical detection scheme must be capable of detection of sub-micrometer vibrations on a rough surface that moves randomly. The surface roughness generates speckles which degrade the sensitivity of standard detection schemes, the lateral relative motion of the target introduces variations in the speckle patterns and the axial relative motion of the target introduces variation in "work-point" of interferometric setups. The present invention alleviates these practical difficulties.

SUMMARY OF THE INVENTION

In accordance with one aspect of the present invention there is provided an optical pin-point microphone comprising:

a light source for directing a sensing beam for directing to an object of interest so as to be reflected thereby as a reflected signal beam, a detector having multiple detector elements for receiving the reflected signal beam, and a summer for receiving signals from at least two of the detector elements and detecting, rectifying, amplifying and summing the received signals to generate a non-vanishing signal representative of an acoustic signal.

In accordance with another aspect of the present invention there is provided a high-fidelity acoustic system comprising in combination with the above-defined optical pin-point microphone, at least one acoustic microphone, and means for fusing respective signals output by the optical pin-point microphone and the at least one acoustic microphone so as to generate a high-fidelity sound with strong background noise suppression.

The invention further provides a method for detecting vibrations off non-specular surfaces, the method comprising:

directing a sensing beam to reflect off an object of interest as a reflected signal, intercepting the reflected beam by a detector having multiple detector elements, and detecting, rectifying, amplifying and summing respective signals of at least two of said detector elements, to generate a non-vanishing signal representative of an acoustic signal.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

A. Basic Interferometer

Figure 1:
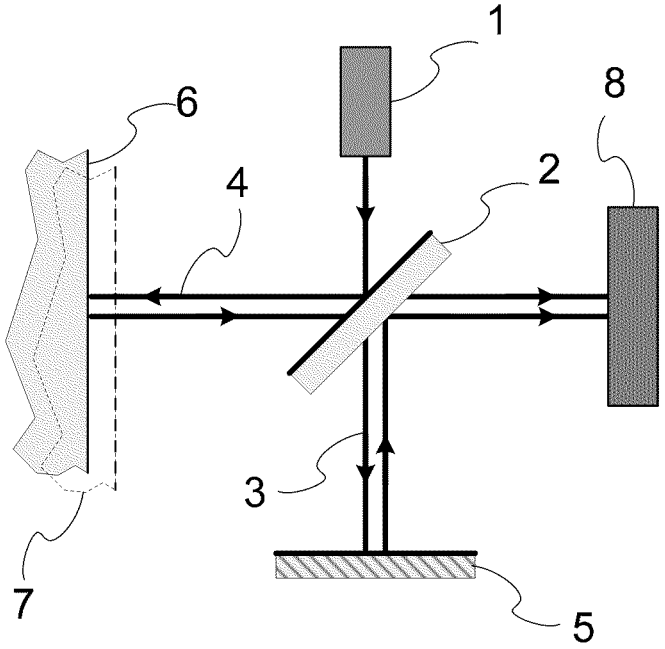
FIG. 1 (Prior Art)
FIG. 1 shows schematically a prior-art optical interferometer for sensing small phase perturbations.

FIG. 1 schematically illustrates a Michelson optical interferometer. This configuration is well known and sufficiently generic to represent other interferometric configurations, such as the Mach-Zehnder, and the following discussion applies to other interferometric arrangements, which are not detailed here in the interest of brevity. In particular, the following discussion addresses interferometric configurations where the reference beam is reflected back on itself (as in FIG. 1), and configurations where the reference beam is directed to travel only in one attitude over its path (as for example is the case in the Mach-Zehnder Interferometer). Although in the interest of brevity the following discussion considers, by way of example, sensing surface perturbations, the description applies to any other interferometric detection of phase perturbations, both in a surface reflected mode, as well as in a transmission through a medium.

As depicted in FIG. 1, in a generic prior-art interferometer a light beam generated by a sufficiently coherent light source 1 (such as a laser), is split by a beam splitter 2 into a reference beam 3 and a probing light beam 4. The reference beam is reflected by a reflector 5 back on to the beam splitter, a portion of which reaches the photodetector 8. The probing beam is reflected off the surface of interest 6. Perturbation of surface 6 to a different location 7 shifts the redirected or reflected probing beam, thereby changing its relative phase. The resulting sensing beam is then redirected through the beam splitter and a portion of it reaches the photodetector 8. The sensing beam interacts with the reference beam on the photodetector to generate an electronic signal in the photodetector which relates to the phase difference between the sensing and reference beams as $$i \propto I_n + I_o\{1+\eta \cos[\phi(t)+\psi(t)+\Delta\phi]\}, \quad (1)$$

where:

- $I_o$ is the intensity of the light source,
- $I_n = I_n(t)$ represents background intensity variation as well as spurious background light noise reaching the photodetector,
- $\eta$ is a measure of the visibility of the interference pattern,
- $\phi = \phi(t)$ the phase variations due to surface perturbations,
- $\psi = \psi(t)$ the phase variations due to spurious environmental effects, and
- $\Delta\phi$ a constant phase difference between the reference and sensing beams.

Figure 2:
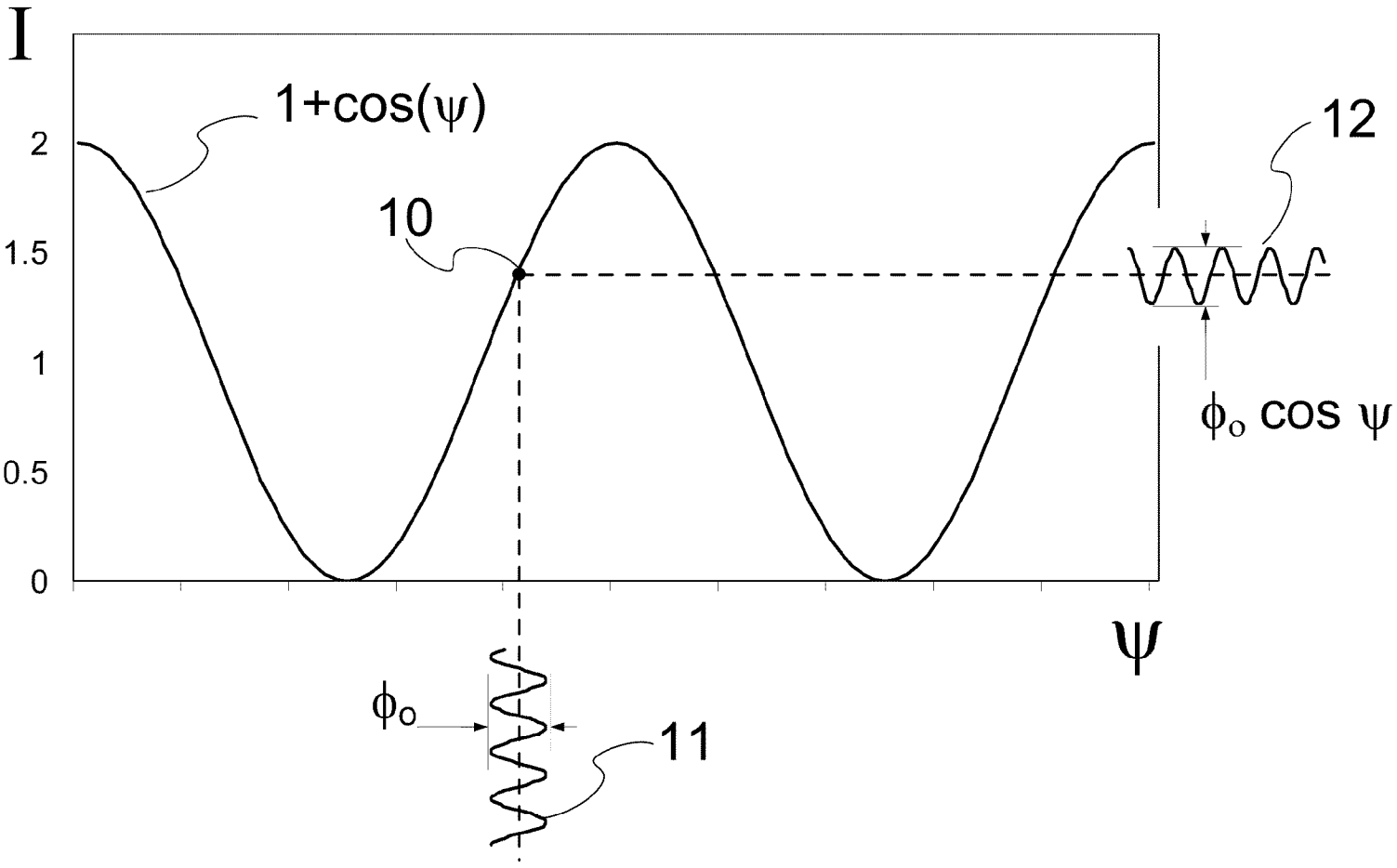
FIG. 2 (Prior Art)
FIG. 2 is a graphical representation of the prior art interferometric response to a small phase signal.

FIG. 2 shows graphically the form of Eq. (1) for unity intensity and visibility ($I_o=1$, $I_n=0$, $\eta=4$). For optimal signal sensitivity, $\Delta\phi$ is selected to place the "work-point" of the interferometer 10 in the steepest slope of Eq. (1), that is, for example $\Delta\phi=\pi/2$. For a small phase signal, $\phi_o$, and at the most sensitive "work point" the time variable portion of Eq. 1 is proportional to $\cos[\phi(t)+\psi(t)+\Delta\phi]=\sin[\phi(t)+\psi(t)]\approx\phi_o \cos\phi+\sin\psi$. Although $\Delta\phi$ is selected here to place the interferometer in a good "work point", the drift of the spurious phase $\phi$ can shift the "work point" to generate a small or even vanishing signal (for small $\cos\psi$), and lead to situations where the detected signal is inverted or otherwise distorted due to operating at a non-linear portion of the interferometric response curve. In this manner environmental effects result in loss of signal and signal distortions in a common interferometer. Of particular interest here is the variation to the target, which is expected to occur on the order of millimeters, or thousands of optical wavelengths introducing thousands of instances where the signal $\phi_o \cos\psi$ vanishes.

B. Speckles

Figure 3B:
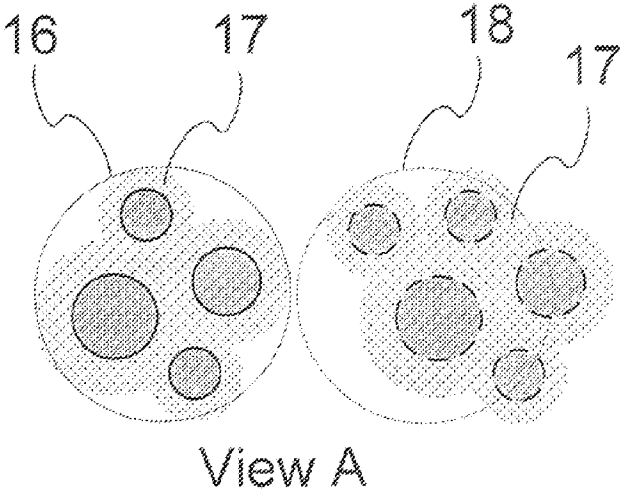
FIG. 3B shows schematically the resulting speckle pattern seen at the detector.
Figure 3A:
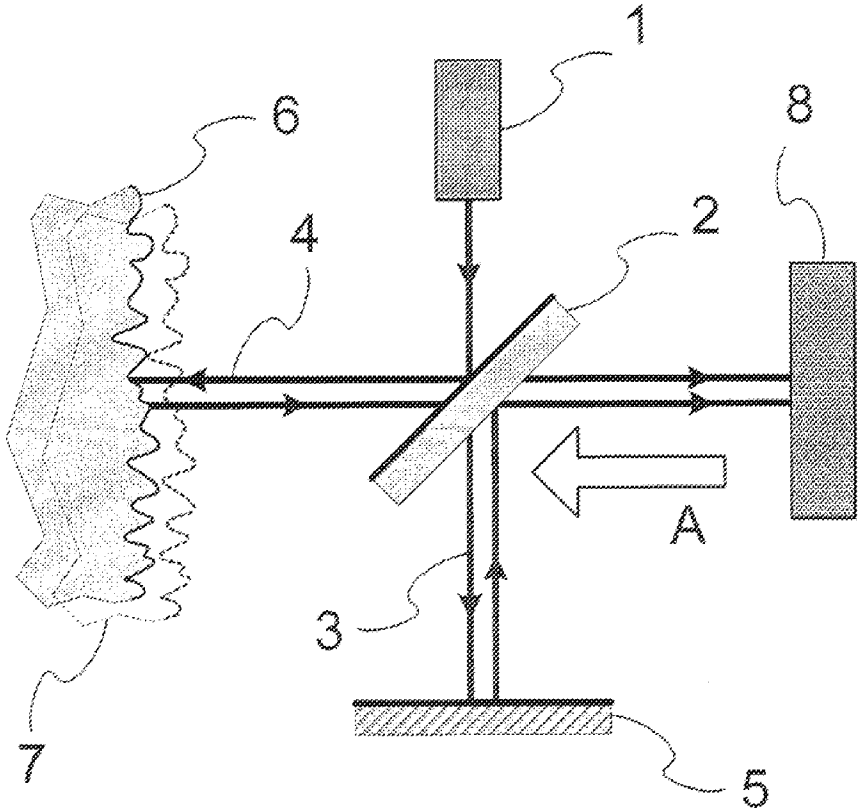
FIG. 3A shows schematically an optical interferometer operating on a rough surface.

FIG. 3A schematically illustrates a generic interferometer operating on a rough surface 6. The interferometric components, a sufficiently coherent light source 1, a beam splitter 2, a reference beam 3, a probing light beam 4, a reference reflector 5 and a photodetector 8, remain as before and serve the same functionality. The probing beam here is reflected off the rough surface 6 and scattered into a speckle pattern 16, shown schematically in FIG. 3B. The speckles are random distribution of intensity and phase 17, resulting from interference of different components scattered from the surface. Perturbation of surface 6 to a different location 7 shifts the redirected or reflected probing beam as before, but now the relative phase change that results can be accompanied by a distortion or shift of the speckle pattern 18. Consequently the signal reaching the photodetector 8 comprises a random distribution of phase and intensities that, combined over the area of the detector, averages out to essentially zero signal.

C. Segmented Detection to Alleviate Speckle Effects

Figure 4B:
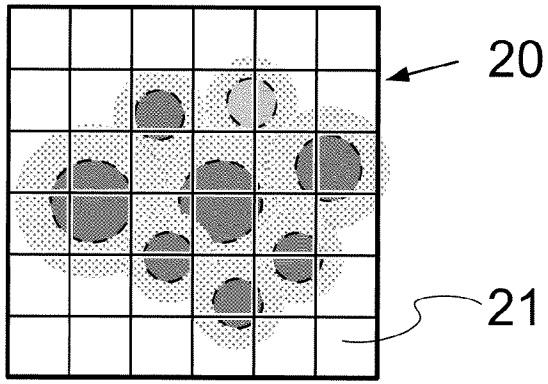
FIG. 4B shows schematically the segmentation of the speckle pattern using a photodetector array.

As discussed above, a rough surface generates a speckle pattern due to interference of scattered components from different parts of the illumination spot on the surface. The typical lateral dimension of each speckle, b, is estimated by $$b \sim 1.22\, \lambda z/D,$$

where $\lambda$ is the wavelength of light, z the axial distance and D the diameter of the lens used to focus the beam onto the surface. Specifically if the surface is illuminated near the focal length of a lens, f, and f~z, we find $$b \sim 1.22\, \lambda f/\#,$$

where f/# is the f-number of the lens. For lenses with relatively large f-numbers, f/#, say 2 to 32, the speckles are formed with characteristic widths ranging from 1 μm to 20 μm, respectively. At the larger end of this range it is relatively straightforward to implement a detector size that is smaller than the speckle. This ensures that the intensity and the phase variations over a single detector element are essentially constant and a finite signal can be detected. This is shown schematically in FIGS. 4A and 4B: the single element detector is replaced with a segmented detector array 12 that effectively segments the detection into an array 20, so that on many of the array elements 21 a finite signal is detected.

Figure 4C:
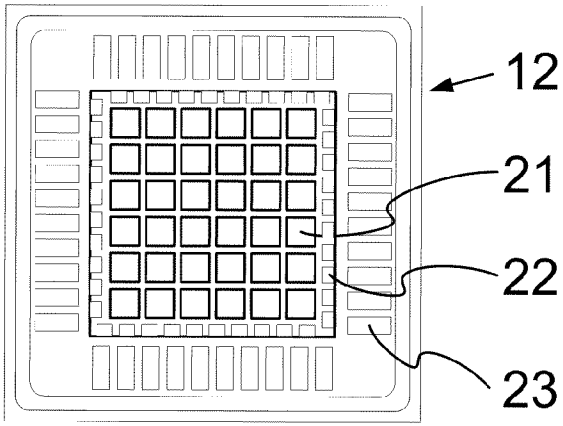
FIG. 4C shows schematically a photodetector array according to an embodiment of the invention.
Figure 4A:
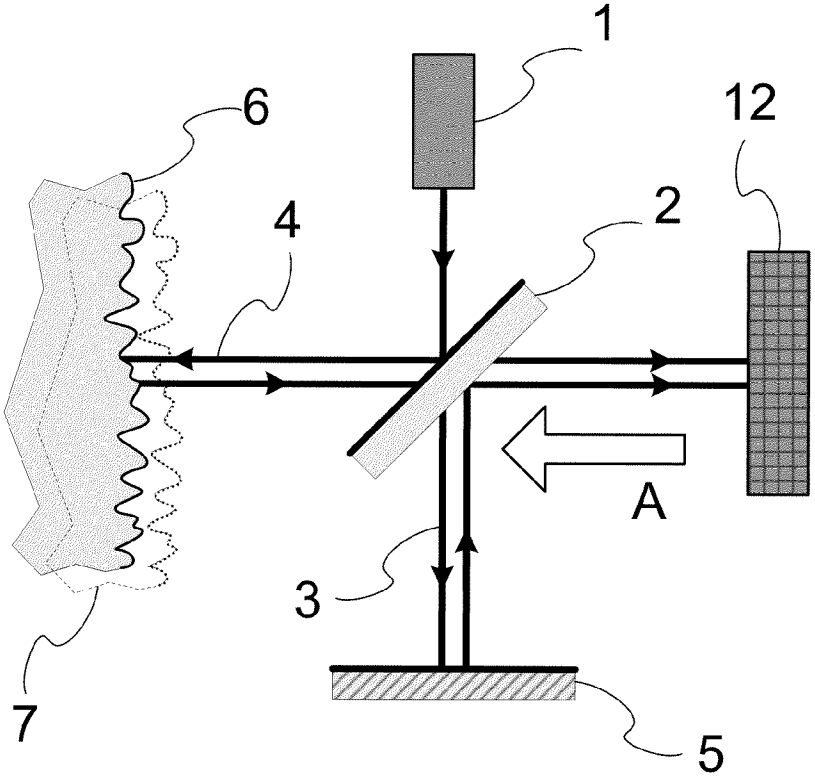
FIG. 4A shows schematically an optical interferometer incorporating a photodetector array.

FIG. 4C illustrates the construction of one embodiment of a photodetector array suitable for advantageously implementing in the present invention. The array 20 is preferably formed from a single semiconductor wafer having a plurality of elements designated generally as 21, which may be formed by etching the semiconductor material. Alternatively the array may be implemented as an assembly of individual detecting elements to form an array of detectors. Detecting elements of different sizes and different shapes are possible. This embodiment shows a 6×6 array, each of approximately 0.1 $mm^2$ area with a pitch of some 12 μm. Suitable electrical contacts 22 are etched on the same semiconductor wafer. The wafer is mounted onto a suitable substrate and the semiconductor contacts 22 are electronically connected to suitable contact pads 23 on the substrate. Typically, wire-bonding can be employed for the electronic contacts. Other bonding methods can also be used. The array 20 can either be mounted in this format onto a hybrid circuit substrate, or packaged in a standard electronic enclosure, such as SMT, BGA, DIP or round metal casings. Alternative methods of assembly are also possible, including the mounting of individual photodetector elements to form a similar overall array.

Figure 5:
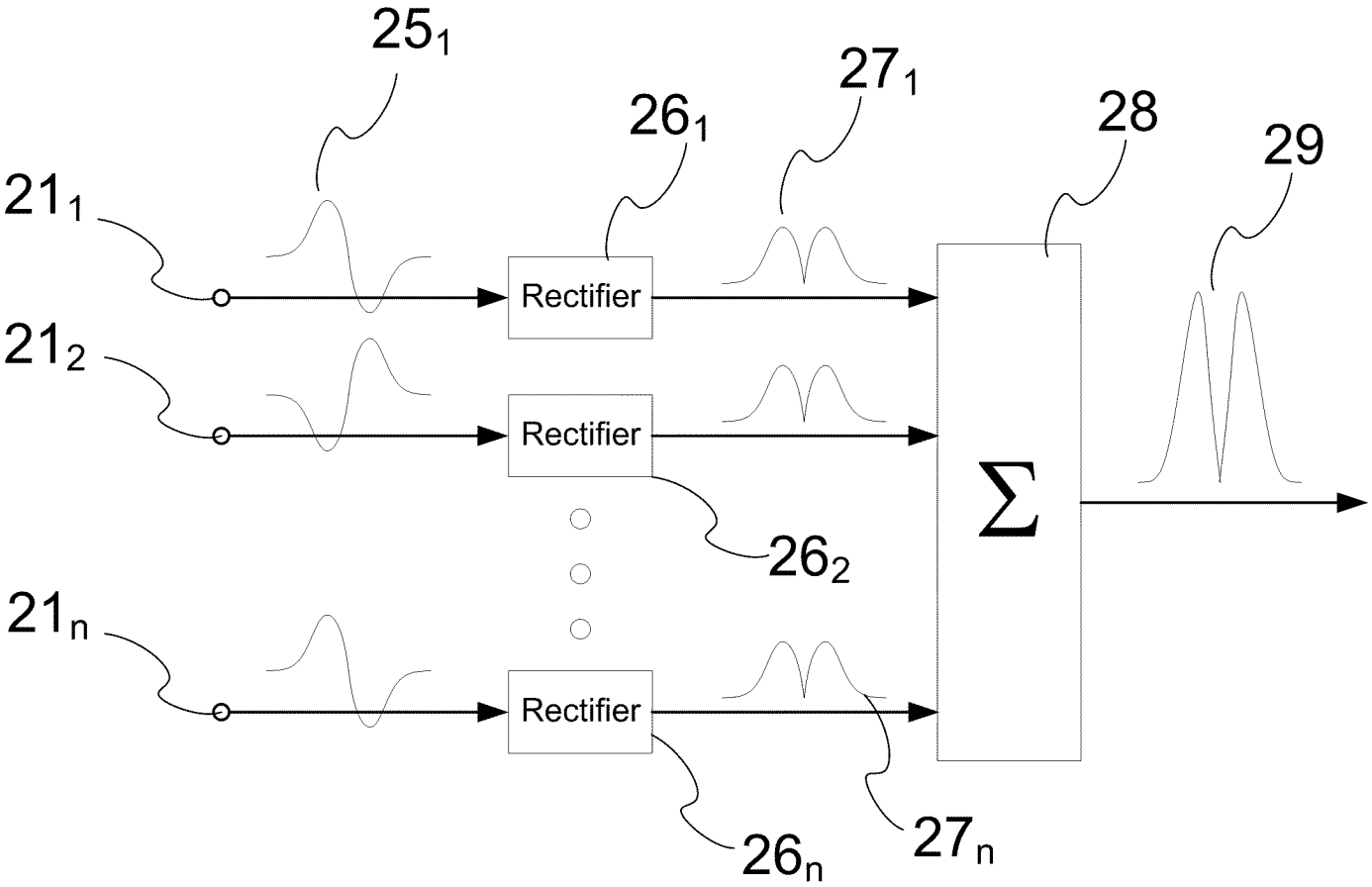
FIG. 5 shows schematically a rectification process for the alleviating the averaging effect of the speckle.

Many of the detector array elements (but not all of them, as the random phase at each speckle can lead to a poor "work point" and essentially a null signal) generate an interferometric signal in the form of Eq. (1). Nevertheless the sign of the detected signal, $\phi_o \cos \psi$, is random as a result of the random phase offset, $\psi$ at each point. Consequently it is still not possible to simply sum the individual signals from all the detector array elements, since the random sign typically leads to a cancellation of the signal. To overcome this difficulty it is possible to first determine the absolute value of each signal and then sum the resulting signals. FIG. 5 schematically illustrates the appropriate electronic components that can accomplish this effect. The $n^{th}$ signal $\mathbf{25}_n$ (also referred to as a first signal) from each element $\mathbf{21}_n$ is fed into a rectifier $\mathbf{26}_n$, and the resulting absolute-value signals $\mathbf{27}_n$ (also referred to as the first signal) are summed with a summer 28. The summer 28 generates a stronger overall non-vanishing signal 29 representative of an acoustic signal, as described above, with improved signal-to-noise. Of course the process of rectifying the individual element signals can be implemented in hardware as indicated above, or with a combination of hardware and firmware or even with software in a separate processor. Likewise, selection of interferometric signals may be achieved in other ways, such as by means of a threshold comparator. The detector array 20 and the summer 28 operate as a speckle-based demodulator.

D. Multi-Phase Interferometry Concept

Figure 6B:
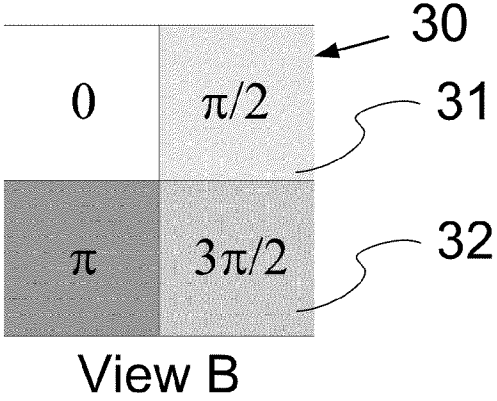
FIG. 6B shows schematically a possible phase pattern of the phase patterner shown in FIG. 6A.
Figure 6A:
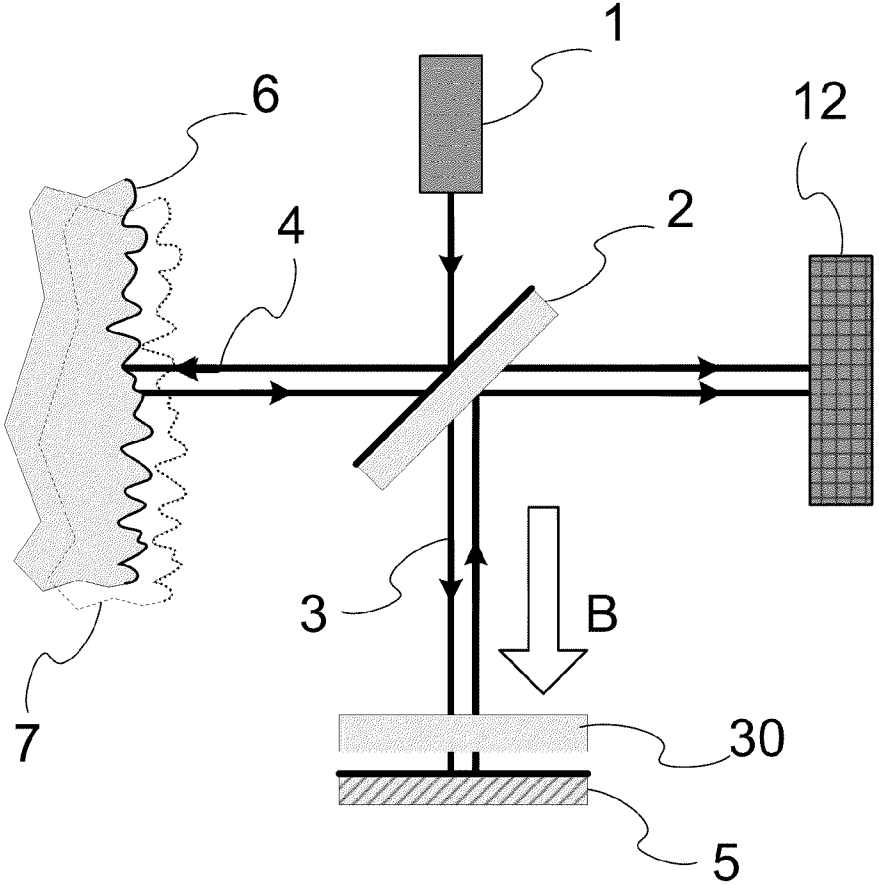
FIG. 6A shows schematically an interferometer incorporating a phase patterner utilizable by the present invention.

WO 08/059487 by the present inventor describes a multiphase interferometer configured to overcome the problem of random variation of the phase $\psi$ in an interferometer. WO 08/059487 employs more than one interferometric channel, each having a different relative phase between the sensing and reference beams, $\Delta\phi$. In the present invention, the interferometric channels are implemented by introducing an array of detectors, designed to detect the signal in different regions of the combined signal and reference beam on the photodetector surface. As described in the following, it is possible to introduce different relative phases to different regions of the combined beam with a phase patterner 30 introduced into the interferometric arrangement, for example as indicated in FIG. 6A, in the path of the reference beam. FIG. 6B shows a preferred phase pattern of the phase patterner 30 utilizable for implementing the current invention. This embodiment shows four phase regions 31, in relative phase steps of $\pi/2$; for example one region 31 introduces a $\pi/2$ delay and another 32 introduces a $3\pi/2$. This arrangement incorporates, for example, a four-segment photodetector array utilizable for implementing four independent photodetector elements for utilizing four interferometric channels for the current invention.

Figure 7A:
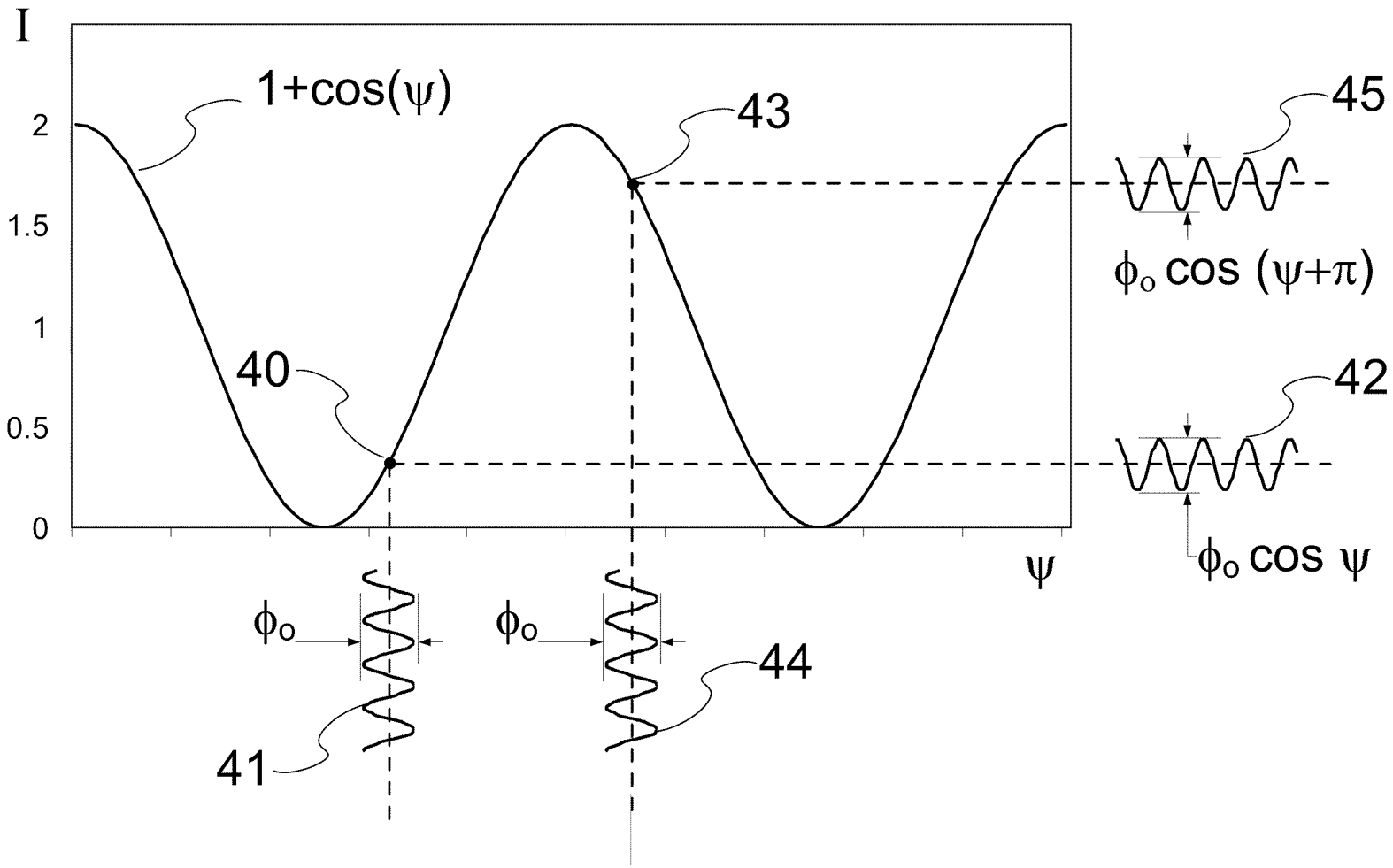
FIG. 7A is a graphical representation of the interferometric response to a small phase signal in two detection channels of the multi-phase interferometer according to an embodiment of the present invention.

As an illustration of the proposed concept, consider first the case of two interferometric channels as shown with the aid of the interferometric response curve of FIG. 7A. To the aforementioned interferometric channel, with "work-point" 40, surface perturbation 34 of amplitude $\phi_o$, and signal 42 of amplitude $\phi_o \cos(\psi)$, a second interferometric channel is added with "work-point" 43. The surface perturbations 44 are the same as for the previous channel, with the same amplitude $\phi_o$, and the resulting signal 45 is of amplitude $\phi_o \cos(\psi+\Delta\phi)$. Judicial choice of $\Delta\phi$ can now ensure that the difference of the two signals can be used to alleviate the intensity noise $I_n$. In FIG. 7A, for example, $\Delta\phi=\pi$, so that subtracting one signal from the other results in a larger overall signal. Furthermore, as seen in the following, channels may be selected so as to ensure that for all $\psi$ at least one of the signals will be non-vanishing, thereby alleviating the difficulty with drift of $\psi$ due to environmental effects.

Using the format of Eq. 1 modified to account for the different channels i, $$i_i \propto I_n + I_o\{1+\eta \cos[\phi(t)+\psi(t)+\Delta\phi_i]\}, \tag{2}$$

a four-channel interferometric system can be formed with $$\Delta\phi_i = 0, \pi 4, \pi/2, 3\pi/4, \tag{3}$$

For which we find:

$$i_1 \propto I_n + I_o\{1+\eta \cos[\phi(t)+\psi(t)]\}, \tag{4a}$$

$$i_2 \propto I_n + I_o\{1+\eta \cos[\phi(t)+\psi(t)+\pi/4]\}, \tag{4b}$$

$$i_3 \propto I_n + I_o\{1+\eta \cos[\phi(t)+\psi(t)+\pi/2]\},$$

$$= I_n I_o\{1-\eta \sin[\phi(t)+\psi(t)]\},$$

$$i_4 \propto I_n + I_o\{1+\eta \cos[\phi(t)+\psi(t)+3\pi/4]\}, \tag{4c}$$

$$= I_n I_o\{1-\eta \sin[\phi(t)+\psi(t)+\pi/4]\}, \tag{4d}$$

Now taking the difference signals, $d_{13}=i_1-i_3$, and $d_{24}=i_2-i_4$, $$d_{13} \propto \eta I_o\{\cos[\phi(t)+\psi(t)]+\sin[\phi(t)+\psi(t)]\}, \tag{5a}$$

$$d_{24} \propto \eta I_o\{\cos[\phi(t)+\psi(t)+\pi 4]+\sin[\phi(t)+\psi(t)+\pi/4]\}, \tag{5b}$$

The difference signals have achieved the two goals of the present invention: (a) they are both independent of any background intensity noise $I_n$; and (b) for any instantaneous value of $\psi$ at least one of these signals is non-zero. For a small phase perturbation, $\phi(t) \ll 1$, the above can be approximated by:

$$d_{13} \propto \eta I_o\{1+\phi(t)\{\sin[\psi(t)]+\cos[\psi(t)]\}\},$$

$$= \sqrt{2}\eta I_o\{[1+\phi(t)]\cos[\psi(t)-\pi 4]\}\}, \tag{6a}$$

$$d_{24} \propto \eta I_o\{[1+\phi(t)]\{\sin[\psi(t)+\pi 4]+\cos[\psi(t)+\pi/4]\}\}$$

$$= \sqrt{2}\eta I_o\{[1+\phi(t)]\cos[\psi(t)]\} \tag{6b}$$

On filtering the DC terms in Eqs. 6 the final form of the signals is:

$$d_{13} \propto \eta I_o \phi(t) \cos[\psi(t)-\pi/4], \tag{7a}$$

$$d_{24} \propto \eta I_o \phi(t) \cos[\psi(t)] \tag{7b}$$

Figure 7B:
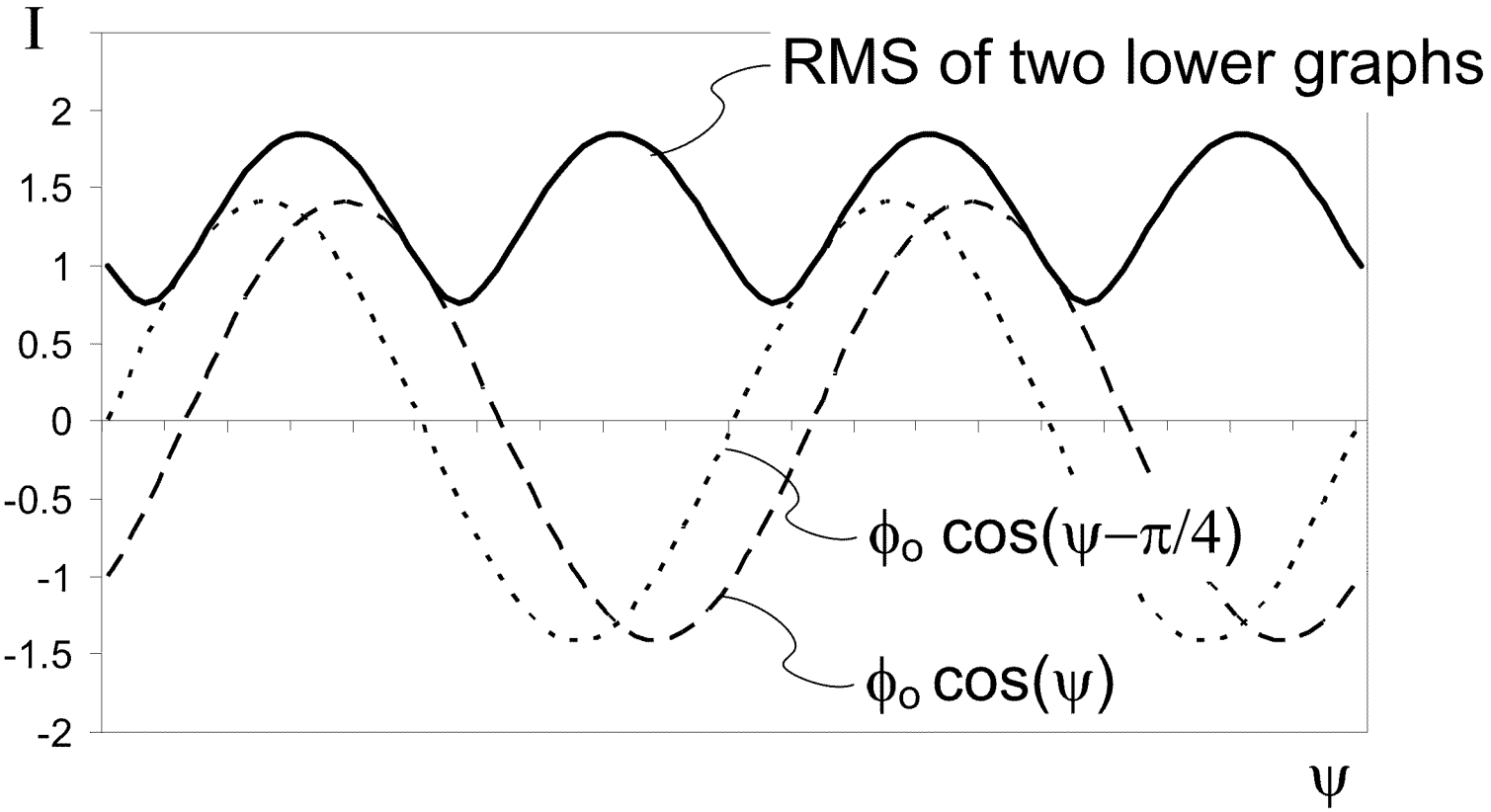
FIG. 7B shows graphically the interferometric response of the difference of two detection channels according to an embodiment of the multi-phase interferometer.

Eqs. 7 shows that the differential detection signals are linearly proportional to the phase modulation $\phi(t)$. Again it is evident that the intensity noise is completely eliminated from the detected signals, and that for any value of the spurious phase drift $\psi(t)$ not both signals vanish. FIG. 7B plots a normalized version of these two signals (with arbitrary phase origin), the dashed line showing graphically that the two signals do not vanish simultaneously, and the solid line showing that their RMS summation, that is $\sqrt{d_{13}^2+d_{24}^2}$, is always greater than 0.7.

Similarly, considering a four-channel interferometric system with the phase pattern of FIG. 6B:

$$\Delta\phi_i = 0, \pi 2, \pi, 3\pi/2, \tag{8}$$

lead, in the case of small phase perturbations, to two differential signals of the form:

$$d_{13} \propto -\eta I_o \phi(t) \sin[\psi(t)], \tag{9a}$$

$$d_{24} \propto \eta I_o \phi(t) \cos[\psi(t)] \tag{9b}$$

Again, the signals of Eqs. 9 are linearly proportional to the phase modulation $\phi(t)$; the intensity noise $I_n$ is eliminated, and for any value of the spurious phase drift $\psi(t)$ at least one of the signals does not vanish. Eqs. 8 have an additional advantage in that they are in perfect quadrature so that their RMS addition is always unity, that is:

$$(d_{13}^2+d_{24}^2)^{1/2}=\eta I_o\phi(t) \quad (10)$$

Eq. 10 shows the important achievements of the current invention: an interferometric signal that is linear with the phase perturbation $\phi(t)$, is independent of any spurious phase disturbances $\psi$, and has filtered out all intensity noise $I_n$.

The two above-described implementations depict four-interferometric channel implementations with different phase patterns. In addition to illustrating that there are many possible implementations for suitable phase patterns, this also indicates that there is broad tolerance in the actual accuracy of the phase shift of each channel, a very significant practical advantage. In addition to varying the values of the phase steps in the phase pattern, their form can be modified. Additional interferometric channels can be implemented by increasing the number of phase steps in the phase patterner and accordingly the number of the detectors elements in the photodetector array.

E. Speckle-Based Phase Patterner

Several implementations of the phase patterner are disclosed in above-mentioned WO 08/059487. The present invention provides a different method for affecting a phase patterner based on the random phases of the speckles.

As described above, considering two interferometric signals with different offset phases, $\Delta\phi$, the invention necessarily ensures that at least one of the interferometric signals is non-zero. A random distribution of phase offsets is inherent to a speckle pattern. Therefore, it is possible to choose, of the many speckles illuminating the detector array, at least two signals that are offset at different phases. Ideally, of course, one would strive to achieve at least four such detection channels, so as to implement as close a detection scheme as possible to the optimal four channel detection with the relative phase differences of Eq. (8).

Figure 8:
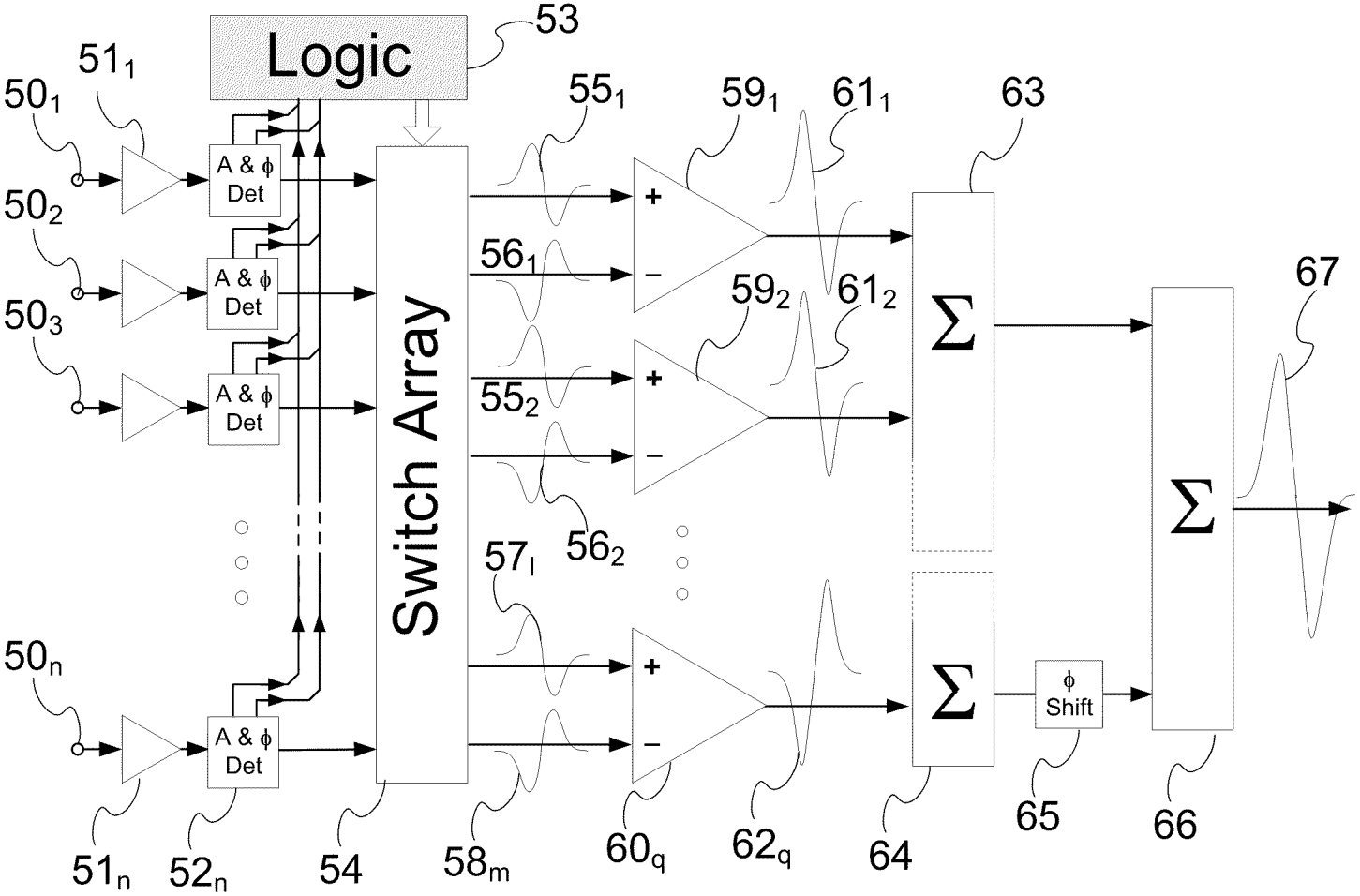
FIG. 8 shows schematically a comparative process for the alleviating the averaging effect of the speckle.
Figure 9:
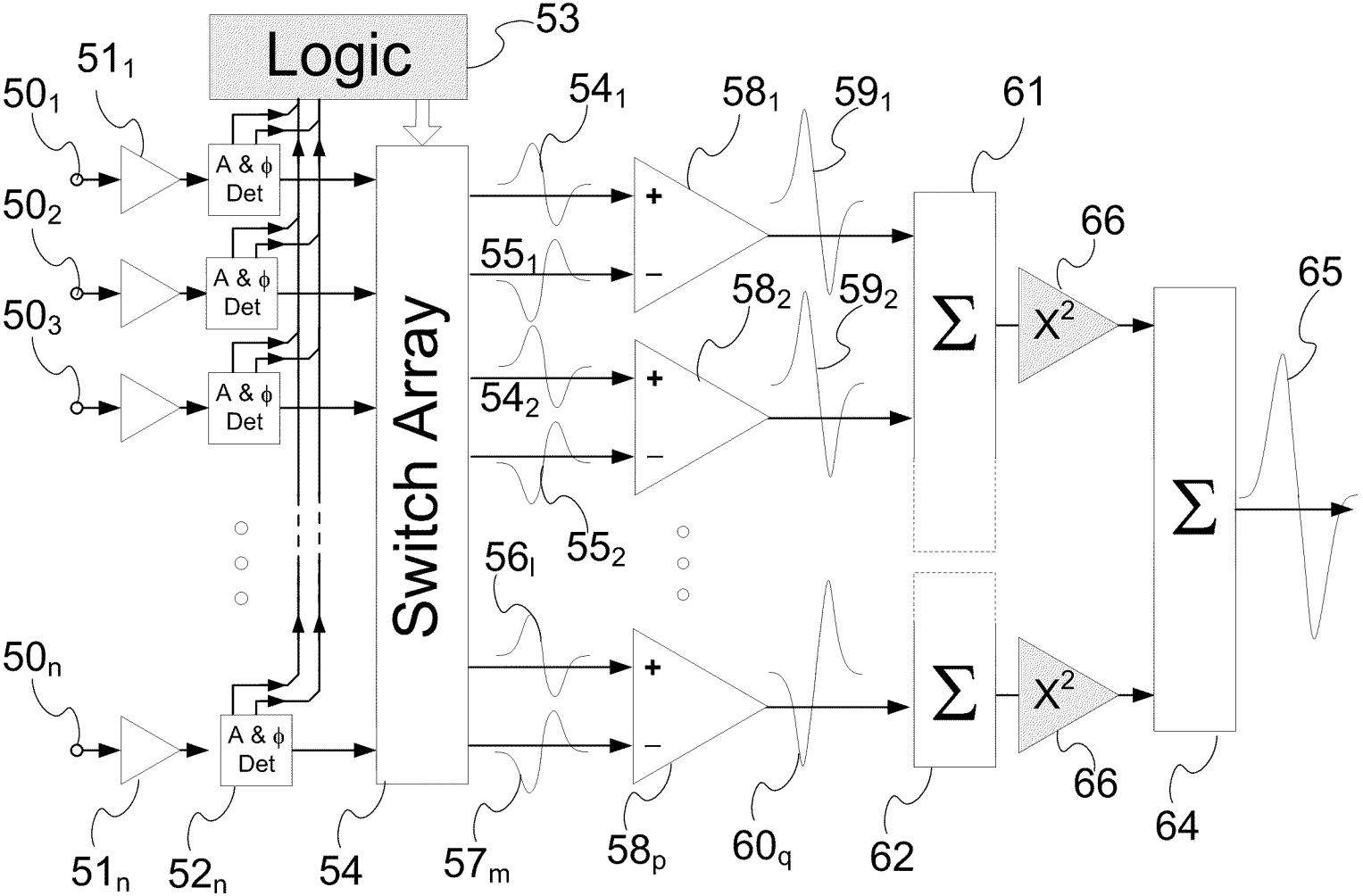
FIG. 9 shows schematically a comparative and signal squaring process for the alleviating the averaging effect of the speckle.

FIG. 8 schematically illustrates an implementation of the above-described multiple phase detection scheme. Each of the n signals from each of the n detector segment of the detector array, $\mathbf{50}_n$, is amplified with amplifiers $\mathbf{51}_n$ and fed into an amplitude and phase detector, $\mathbf{52}_n$. Each amplitude and phase detector serves to identify the amplitude and relative phase of the signal detected by each detector element. This information is fed into a processor 53 which serves to group the detector elements into five categories: (a) those where the signal is minimal, that is the amplitude is below a predefined threshold; and (b) through (e) for those with a relative phase in the first quadrant, second, third and fourth quadrants (marked as signals $\mathbf{55}_l$ through $\mathbf{55}_j$; $\mathbf{56}_l$ through $\mathbf{56}_k$; $\mathbf{57}_l$ through $\mathbf{57}_i$; and $\mathbf{58}_l$ through $\mathbf{55}_m$; in order to avoid clutter in the figure, only representative signals form each group are marked). The signal from elements in group (a) cannot contribute to the overall signal and are simply ignored. The "first quadrant" signals from elements in group (b) are directed through the matrix switch array 54 and fed into one input of a set of differential amplifiers $\mathbf{59}_k$ through $\mathbf{59}_j$. Similarly the "second quadrant" signals in group (c) are directed through the switch array 54 and fed into the second input of the same set of differential amplifiers $\mathbf{59}_l$ through $\mathbf{59}_p$ (FIG. 8 shows only the first differential amplifiers in the set: $\mathbf{59}_l$ and $\mathbf{59}_2$). Thereby each of the differential amplifiers generates the difference signal ($\mathbf{61}_l$ through $\mathbf{61}_p$) in the general form of Eq. 9a. Similarly, the "third and fourth quadrant" signals from groups (d) and (e), respectively, are fed to the two inputs of a second set of differential amplifiers $\mathbf{60}_l$ through $\mathbf{60}_q$ (FIG. 8 shows only the last differential amplifier in the group: $\mathbf{60}_q$). Here signals of the form of Eq. 9b ($\mathbf{62}_l$ through $\mathbf{62}_p$) are formed in each of the differential amplifiers $\mathbf{60}_q$. The respective signals in each set of signals are roughly in phase and therefore can be added to generate a larger signal with improved signal-to-noise (SNR) using a summer 63 for the first set of difference signals and a second summer 64 for the second set of difference signals. As these are, in general, in the form of Sine and Cosine, shifting one of the difference signals with a phase shifter allows their addition with a third summer 66 to obtain a stronger overall signal 67 with improved SNR.

F. Multiplexed Beam-Enhanced, Speckle-Based Multi-Phase Interferometry

As described above, a speckle pattern can be used to advantage to form a multi-phase interferometer signal. Nevertheless, as the signals generated in this fashion are random in nature, a large portion of the signal power remains unmodulated (that is does not carry the signal of interest). To increase the power of the useful signal components, it is possible to multiplex more than one type of light into the signal beam. One example is to use two polarizations in the signal (and reference) beam. In this approach, the signal beam is split into two different polarization states, using a polarization splitter, each then being incident on a separate detector array. Here each polarization state generates the speckle-based multiphase interferometer signal, on average increasing the random occurrence of useful signal power by a factor of two. Similarly and additionally the signal beam can be multiples of more than one wavelength. Again different wavelengths can be split and incident of different detector arrays, on average increasing the random occurrence of useful signal power by a factor of two.

G. Super Directional Microphone

The optical pin-point microphone described above can be used in a variety of applications where super-directional acoustic pickup is required. Examples include directional microphones to pick up the sound of a single instrument within an orchestra for high-fidelity recording, the pickup of the sound of a single loudspeaker within a set of speakers in a large room to determine the fidelity of the particular device and its performance within the system.

More challenging are pick-up of voice from a distant person in several different situations where the optical pin-point microphone is set to pickup the voice-induced vibrations from the speaker's head. Here the vibrations generated by voice in the human head are small (on the sub-nanometer scale). Furthermore the amplitude of these signals drops fast as the frequency of the voice signals exceeds about 2 KHz. Therefore, for improved sound fidelity it may be necessary to augment the optical pin-point microphone by fusing the low frequency signal picked-up by the optical microphone with the broad-band (but noisy) signal from a standard acoustic microphone. Fusion of the respective signals output by two such microphones has been successfully demonstrated in recent years, and shown to provide a high fidelity signal with strong background suppression. Such applications include pick-up of voice from a distant person in a public area for homeland security applications and the directional hearing aid described below.

H. Directional Hearing Aid

Figure 10:
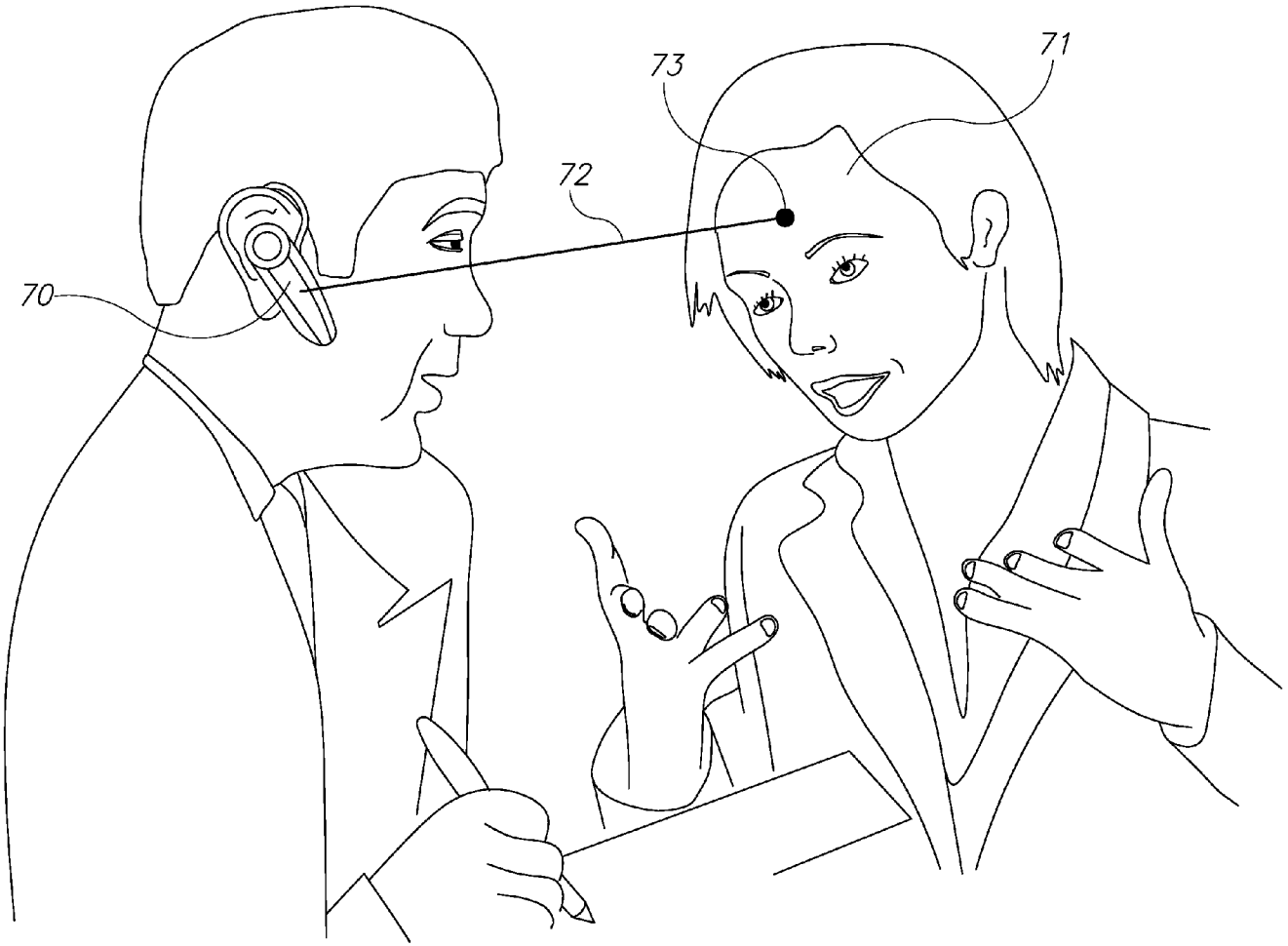
FIG. 10 shows pictorially use of an embodiment of the current invention as a directional hearing aid for the hearing impaired.

FIG. 10 illustrates an application of the proposed pin-point optical microphone. This implementation is devised to assist people with hearing impairments to converse with partners in noisy environments. State-of-the-art hearing-aids can amplify the signals to overcome a basic decline in hearing sensitivity. Nevertheless, unlike the phenomenal capability of the human ear to pick up a conversation within a loud background noise (which can even be louder than the conversation partner—this is termed "the cocktail effect"), hearing aids amplify both the conversation "signal" and the background noise, making it impossible to distinguish between them. Consequently people with hearing deficiencies cannot effectively communicate in noisy environments, such as restaurants or other public areas.

The hearing-aid device described herein alleviates this difficulty and provides a useful tool to converse with a partner. The pin-point microphone is integrated into a wearable device, 70, that is worn by the person with impaired hearing. This user can deploy the device by pointing its beam, 72, at his conversation partner, as indicated schematically in FIG. 10. The pin-point microphone picks up the minute vibrations generated within the conversation partner's head, 71 (for example the forehead). As described above (Background section) these vibrations essentially contain no acoustic airborne signals, and pick up the voice of the conversation partner with any background noise suppressed. The voice of the conversation partner is then amplified, filtered and if needed fused with a signal from a standard acoustic microphone (see previous section) and transmitted directly to the user's ear, or cheek-bone as done in state-of-the art hearing aids.

The optical pin-point microphone shown in FIG. 10 deploys visible light, and as such facilitates the function of aiming its sensing beam, 72, to impinge on the head, 71, of the person with whom conversation is held. In particular, the user observes the reflection and scatter at the point, 73, where the sensing beam impinges on the head of the conversation partner. If conversation is held with more than one person, the visible light beam can be used to aim the optical pin-point microphone at the correct person. Nevertheless, it may be advantageous or desirable to use an invisible wavelength for this purpose. An invisible beam may be more socially acceptable. Furthermore operation in the eye-safe regime (1.5-1.6 μm) allows for use of much higher laser intensities within the allowed safety guidelines. In such cases a mechanical (e.g. edge of worn device) sight, or optical (e.g. holographic reticule or mark integrated in an eye-glasses lens) sight or weak visible aiming beam can be used to aim the optical pin-point microphone in the desired direction.

It will be evident to those skilled in the art that the invention is not limited to the details of the foregoing illustrated embodiments and that the present invention may be embodied in other specific forms without departing from the scope of the claims. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed:

1. An optical pin-point microphone comprising:

a light source, the light source directs a sensing light beam to an object of interest, the object of interest being a person generating a sound and having a rough surface, wherein the rough surface vibrates acoustically and is the person's skin, the rough surface reflects and scatters the sensing light, the scattered, reflected sensing light has a speckle pattern comprising multiple speckles, the multiple speckles have a random distribution of phase offsets;

a first detector array comprised of multiple detector elements, the first detector array receives and detects the speckle pattern, and each of the multiple detector elements produces a first signal that is linearly proportional to phase modulation of the multiple speckles; and a summer that: (a) receives the first signal from at least two of the multiple detector elements of the first detector array and each first signal is offset at different phases, and (b) sums the received first signals, and (c) generates a non-vanishing signal that represents an acoustic signal.

2. The optical pin-point microphone of claim 1, wherein the summer receives the first signal from at least four of the multiple detector elements of the first detector array.

3. The optical pin-point microphone of claim 1, wherein the scattered, reflected sensing light comprises two polarization states and there is further included a polarization splitter, the polarization splitter: (a) receives the speckles from the scattered, reflected sensing light and (b) directs the speckles of the scattered, reflected sensing light to a second detector array according to the speckle's polarization state, said second detector array comprised of multiple detector elements.

4. The optical pin-point microphone of claim 3, wherein the summer receives the signals in each of the polarization states from at least four detector elements in each of the first and second detector arrays.

5. The optical pin-point microphone of claim 1, wherein the speckle pattern comprises at least two wavelengths, each incident on a respective detector array for each of which the signals of at least two detector elements are detected, amplified and summed to generate the non-vanishing signal.

6. The optical pin-point microphone of claim 5, wherein the summer receives respective signals at each wavelength from at least four detector elements on each of the respective detector arrays.

7. A high-fidelity acoustic system comprising:

the optical pin-point microphone of claim 1, at least one acoustic microphone, and means for fusing respective signals output by the optical pin-point microphone and the at least one acoustic microphone so as to generate a high-fidelity sound with strong background noise suppression.

8. A wearable hearing aid device comprising the optical pin-point microphone according to claim 1 that, detects voice vibrations off a person's head, converts the voice vibrations into a voice signal and transmits the sound, after amplification to the user's ear.

9. The device of claim 8, wherein the sensing beam of the optical pin-point microphone is in the visible spectrum.

10. The device of claim 8, wherein the sensing beam of the optical pin-point microphone is outside the visible spectrum, and the device includes a mechanical aiming component.

11. The device of claim 8, wherein the sensing beam is outside the visible spectrum, and the device includes an optical aiming component.

12. The device of claim 8, wherein the sensing beam is outside the visible spectrum, and the light source produces a weak visible aiming beam.

13. A method for detecting vibrations off non-specular surfaces, the method comprising the steps of:

directing a sensing light beam to an object of interest, the object of interest being a person generating a sound and having a rough surface, wherein the rough surface vibrates acoustically and is the person's skin, the rough surface reflects and scatters the sensing light, the scattered, reflected sensing light has a speckle pattern comprising multiple speckles, the multiple speckles have a random distribution of phase offsets;

intercepting the speckle pattern by a first detector array comprising multiple detector elements, each of the multiple detector elements produces a first signal that is linearly proportional to phase modulation of speckles in the speckle pattern;

selecting at least two of said first signals that are offset at different phases; and detecting, amplifying and summing said at least two first signals that are offset at different phases, and generating a non-vanishing signal that represents an acoustic signal.

14. The method of claim 13, when used to suppress background airborne sound.

15. The method of claim 13, further comprising the step of fusing the non-vanishing signal that represents an acoustic signal with a signal obtained from an acoustic microphone, and further generating a signal representative of a high-fidelity sound with strong background noise suppression.

16. The optical pin-point microphone of claim 1, wherein the object of interest is a person speaking and the rough surface is the person's skin.

17. The method of claim 13, wherein the object of interest is a person speaking and the rough surface is the person's skin.

* * * * *